US009909200B2

(12) United States Patent
Aoki et al.

(10) Patent No.: US 9,909,200 B2
(45) Date of Patent: Mar. 6, 2018

(54) METHOD OF MANUFACTURING NI-BASE SUPERALLOY

(71) Applicant: HITACHI METALS, LTD., Tokyo (JP)

(72) Inventors: Chuya Aoki, Shimane (JP); Tomonori Ueno, Shimane (JP)

(73) Assignee: HITACHI METALS, LTD., Tokyo (JP)

( * ) Notice: Subject to any disclaimer, the term of this patent is extended or adjusted under 35 U.S.C. 154(b) by 0 days.

(21) Appl. No.: 15/512,458

(22) PCT Filed: Sep. 29, 2015

(86) PCT No.: PCT/JP2015/077553
§ 371 (c)(1),
(2) Date: Mar. 17, 2017

(87) PCT Pub. No.: WO2016/052523
PCT Pub. Date: Apr. 7, 2016

(65) Prior Publication Data

US 2017/0283926 A1 Oct. 5, 2017

(30) Foreign Application Priority Data

Sep. 29, 2014 (JP) ..... 2014-199306

(51) Int. Cl.
*C22F 1/10* (2006.01)
*C22C 19/05* (2006.01)
(Continued)

(52) U.S. Cl.
CPC *C22F 1/10* (2013.01); *B21J 3/00* (2013.01); *B21J 5/025* (2013.01); *C21D 1/68* (2013.01); *C22C 19/051* (2013.01)

(58) Field of Classification Search
CPC ..... C22F 1/10; C22C 19/05
See application file for complete search history.

(56) References Cited

U.S. PATENT DOCUMENTS 3,962,490 A 6/1976 Ward
4,154,075 A 5/1979 Spiegelberg
(Continued)

FOREIGN PATENT DOCUMENTS

EP 0003419 A2 8/1979
EP 1624084 A1 2/2006
(Continued)

OTHER PUBLICATIONS

International Search Report dated Nov. 17, 2015 filed PCT/JP2015/077553.
(Continued)

*Primary Examiner* — Jessee Roe
(74) *Attorney, Agent, or Firm* — Rankin, Hill & Clark LLP

(57) ABSTRACT

There is provided a method of manufacturing an Ni-base superalloy which enables a uniform coat of a glass lubricant to be maintained even after heated to hot forging temperature. The method of manufacturing an Ni-base superalloy in which a forging stock containing an Ni-base superalloy, coated with a lubricant, is subjected to hot forging includes: a preliminary oxidation step of previously generating a Cr oxide coating film having a film thickness of 0.5 to 50 μm on the forging stock thereby to obtain a preliminarily oxidized material; a lubricant coating step of coating the preliminarily oxidized material with a glass lubricant containing borosilicate glass as a main component thereby to obtain a material to be forged; and a hot forging step of hot forging the material to be forged thereby to obtain a hot forged material.

15 Claims, 1 Drawing Sheet

(51) Int. Cl.

| | |
|---|---|
| ***B21J 3/00*** | (2006.01) |
| ***C21D 1/68*** | (2006.01) |
| ***B21J 5/02*** | (2006.01) |

(56) References Cited

U.S. PATENT DOCUMENTS

| | | | |
|---|---|---|---|
| 4,183,236 | A | 1/1980 | Moracz |
| 5,242,506 | A | 9/1993 | Dorrell |
| 2008/0011035 | A1 | 1/2008 | Voice |
| 2012/0183708 | A1 | 7/2012 | Kennedy |
| 2014/0290321 | A1 | 10/2014 | Kennedy |

FOREIGN PATENT DOCUMENTS

| | | | |
|---|---|---|---|
| EP | 2703454 | A1 | 3/2014 |
| GB | 1496192 | A | 12/1977 |
| JP | 5913073 | | 1/1984 |
| JP | 5996273 | | 6/1984 |
| JP | 01219039 | | 9/1989 |
| JP | 06504302 | | 5/1994 |
| JP | 06254648 | | 9/1994 |
| JP | 2014508857 | | 4/2014 |

OTHER PUBLICATIONS

Extended European Search Report dated Jun. 22, 2017 issued in the corresponding European patent application No. 15846439.6.

METHOD OF MANUFACTURING NI-BASE SUPERALLOY

TECHNICAL FIELD

The present invention relates to a method of manufacturing an Ni-base superalloy.

BACKGROUND ART

Members used in airplanes and power generation turbines include an Ni-base superalloy represented by 718 alloy which is excellent in corrosion resistance and high temperature strength. The crystal grains and the precipitation strengthening phase of the superalloy used in the above-described members of airplanes and power generation turbines are adjusted in size by hot forging and heat treatment. As a result, this superalloy has excellent high temperature strength.

Among these, for example, a turbine disk is a large-sized rotor having a complicated shape. In addition, fatigue strength, among strength properties, is particularly regarded as important. Therefore, in a hot forging step, securement of the shape of a large-sized product and containment of fine crystal grains in the endoplastic surface are required to be achieved by near-net-shape closed die forging. Crystal grains become finer by sufficiently promoting recrystallization at the temperature range which allows for the precipitation of pinning particles. Accordingly, an extraordinarily large forming load is required for balancing both of shape and quality in the closed die forging of a large-sized rotating member. However, realistically, a limit exists in press load capabilities.

Therefore, a lubricant is applied on a forging stock during hot forging. The main effect of a lubricant is the operation of reducing the frictions between a forging stock and a die. This effect is achieved by forming a continuous lubrication coating film on a forging stock while maintaining an optimum viscosity of a lubricant during hot forging. In order to manufacture a large-sized forged product within the range of press load capabilities, the role of a lubricant in reducing a forming load becomes important.

The invention of this hot forging method with a lubricant is disclosed in, for example, JP-A-6-254648 (Patent Literature 1).

CITATION LIST

Patent Literature

Patent Literature 1: JP-A-6-254648

SUMMARY OF THE INVENTION

Problems to be Solved by the Invention

The invention described in Patent Literature 1 is excellent in that a graphite-based lubricant is used in isothermal forging in which forging is performed at a temperature range of 1100 to 1200° C. at low strain speed, thereby preventing oxidation corrosion of a die. However, in general closed die forging in which the cost of dies is reduced, there is used glass lubrication in which the effect of reducing a forming load is higher.

When a forging stock is coated with a glass lubricant, it is desirable that hot forging be performed while the glass lubricant uniformly applied by spraying, brushing, immersion, or the like maintains uniform thickness. However, there has been a problem that the applied glass lubricant partially flies after the temperature has increased to hot forging temperature.

When the thickness of a glass lubricant becomes non-uniform, the frictions between a material to be processed and a die increase in a portion where a glass lubrication coating film has flown. This also invites increase of a forming load. A glass lubricant has the function of thermal insulation, as well as the function of reducing the frictions between a forging stock and a die. Therefore, there has also been a problem that when the glass lubricant applied on a forging stock is not partially wet, unevenness in temperature of a material to be processed is caused during forging, resulting in non-uniform molding.

An object of the present invention is to provide a method of manufacturing an Ni-base superalloy which enables a uniform coat of a glass lubricant to be maintained even after heated to hot forging temperature.

Solution to the Problems

The present invention has been achieved in view of the above-described problems.

That is, a method of manufacturing an Ni-base superalloy, in which a forging stock including an Ni-base superalloy, coated with a lubricant, is subjected to hot forging, according to the present invention includes: a preliminary oxidation step of previously generating a Cr oxide coating film having a film thickness of 0.5 to 50 μm on the forging stock; a lubricant coating step of coating the forging stock having been subjected to the preliminary oxidation step with a glass lubricant including borosilicate glass as a main component; and a hot forging step of hot forging the forging stock having been subjected to the lubricant coating step.

Effects of the Invention

According to the present invention, a uniform coat of a glass lubricant can be maintained even after heated to hot forging temperature. Therefore, even in the case of, for example, a large-sized and complicated product, a near-net-shape forged product can be hot forged at a low load.

DESCRIPTION OF THE EMBODIMENTS

Figure 1:
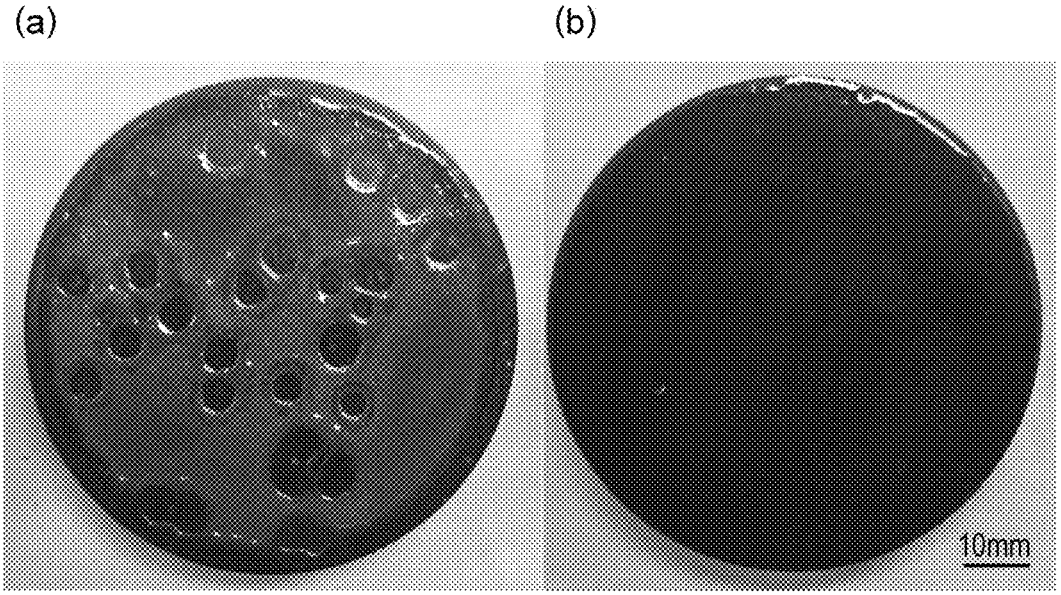
FIG. 1 is appearance photographs indicating differences in wettability of a glass lubricant.

The present invention will be described in detail below.

First of all, the "Ni-base superalloy" as described herein refers to an austenite-based heat-resistant alloy which contains as an essential component, in terms of mass %, 50% or more of Ni and 10% or more of Cr, and further contains, for example, a strengthening element such as Co, Al, Ti, Nb, Mo, and W. The Ni-base superalloy endures the use under high temperature environment. Therefore, this Ni-base superalloy is characterized by good oxidation resistance, and good high-temperature strength achieved by solid solution strengthening and precipitation strengthening of gamma prime, gamma double prime, and the like.

Also, a forging stock to be used is not particularly limited, and examples thereof may include cylindrical billets, ring-shaped preform, and hot forged products having been subjected to hot forging. Also, the surface of a forging stock to be used is preferably cleaned by surface polishing such as surface grinding and blast treatments such as shot blasting and sand blasting, for the purpose of removing oil and foreign substances retained on the surface.

It is noted that "hot forging" as described herein also includes isothermal forging and hot die forging.

<Preliminary Oxidation Step>

In the present invention, preliminary oxidation of the above-described forging stock is performed. The purpose of the generation of a Cr oxide coating film by preliminary oxidation is to improve wettability with a later-described glass lubricant which includes borosilicate glass as a main component. In brief, an oxide coating film, which has good wettability with a glass lubricant, is previously generated on a forging stock. This enables the forging stock to be uniformly coated with a glass lubricant during the temperature rising to hot forging temperature which is performed afterward.

Also, the thickness of a Cr oxide coating film to be generated is necessary to be 0.5 to 50 μm. When the thickness of the Cr oxide coating film is less than 0.5 μm, supply of oxygen from the Cr oxide coating film to the glass lubricant becomes insufficient, causing wettability to decrease. On the other hand, even when a Cr oxide coating film having a thickness of more than 50 μm is generated, the wettability with the glass lubricant is not further improved. Furthermore, heating is unnecessarily retained for an extended time during the preliminary formation of the oxide coating film. Thus, the cost increases.

This preliminary oxidation step may be performed at a temperature range of 900° C. to hot forging temperature, so that a Cr oxide coating film is formed in a continuous manner on the entire surface layer of a forging stock. When lower than 900° C., it is sometimes difficult to generate a uniform Cr oxide coating film on the surface of a forging stock. On the other hand, the upper limit temperature of the preliminary oxidation step is hot forging temperature. The hot forging temperature varies depending on the type of the forging stock and the size of crystal grains to be targeted. For example, in the case of 718 alloy, the hot forging temperature is 950 to 1050° C. The temperature of the preliminary oxidation step exceeding hot forging temperature is not preferable, since the crystal grains of a forging stock could be coarsened during the preliminary oxidation treatment. Also, as treatment time, 1 to 10 hours is sufficient.

This preliminary oxidation also has the effect of suppressing the wettability failure of a glass lubricant which is caused during the temperature rising process when a forging stock coated with the glass lubricant is subjected to pre-forging heating. The reason thereof will be described below.

Reducing the unevenness in temperature of the inside and outside of a forging stock caused by the temperature rising during the pre-forging heating as much as possible is extraordinarily important for securing the uniformity of a microstructure and also the reliability of mechanical properties. Therefore, in order to secure the uniformity of a microstructure of the inside and outside of a forging stock immediately before forging, there is adopted a method of increasing temperature in a stepwise manner while maintaining the temperature lower than forging temperature. In the stepwise temperature rising, a Cr oxide is gradually formed. However, bonding between a forging stock and a glass lubricant is also initiated. Therefore, if the progress of the formation of a Cr oxide is insufficient, wettability failure of glass is caused. In a portion where wettability failure has been caused, glass flies, thereby inhibiting glass from spreading by wetting. Consequently, preliminary oxidation for previously forming a Cr oxide is also an effective measure for balancing the reduction of unevenness in temperature of the inside and outside of a forging stock and the favorable wettability of glass in the pre-forging heating step.

As another effect, bonding is a reaction among Cr, borosilicate glass, and oxygen. Therefore, when heated in the ambient atmosphere having a high oxygen concentration, glass is likely to become wet to a forging stock. However, since natural gas or heavy oil, for example, is used as fuel in a generally used heating furnace, the atmosphere has a low oxygen concentration. In that case, since the supply of oxygen from the furnace is low, bonding between Cr and glass becomes insufficient. That is, part of glass becomes unlikely to become wet. Therefore, the method of previously performing preliminary oxidation to a forging stock before coating the forging stock with glass thereby to form a Cr oxide on the surface layer of the forging stock for the purpose of compensating for the insufficient supply of oxygen which enters glass from the furnace is effective.

<Glass Lubricant>

A glass lubricant is inevitably required to have a high forming load in order to, for example, obtain fine crystal grains by closed die forging. Therefore, for performing forging within the range of press load capabilities, reducing the frictional force between a forging stock and a die with a lubricant becomes important. Especially, the glass lubrication which enables a sufficient lubrication effect to be obtained even when the temperature of a die used in hot forging exceeds 500° C. is effective. In particular, a glass lubricant containing borosilicate as a main component and being excellent in heat resistance is suitable.

As described herein, the "glass lubricant containing borosilicate glass as a main component" refers to a glass lubricant which contains, in terms of mass %, 70% or more of $SiO_2$ and 10% or more of $B_2O_3$. It is noted that oxygen in the glass formation oxide is constituted as crosslinking oxygen. Accordingly, this glass lubricant has high binding energy, high-temperature stability, and high viscosity. Therefore, the glass formation oxide does not function as a lubricant by itself. Therefore, $Al_2O_3$, $Na_2O$, CaO, $K_2O$, or the like, which is an intermediate oxide or a network modifier oxide, is added to constitute non-crosslinking oxygen. This enables the viscosity of glass to be reduced at the high-temperature range in which hot forging is performed.

As a method for coating a forging stock with the above-described glass lubricant, there can be adopted the method of coating the entire forging stock with a powder of the glass lubricant together with a solvent by spraying, brushing, immersion, or the like, and drying the coat to remove the solvent. Among these, spray coating, by which control of the coating thickness is facilitated, is preferable. Furthermore, automatic spray coating by a robot is most suitable as the coating method.

Also, the coating thickness of the glass lubricant is preferably 100 μm or more so that the glass reliably has continuous film properties during hot forging. When less than 100 μm, lubrication sometimes becomes partially insufficient, thereby impairing the friction reduction effect. The preferable thickness of the coat is 200 μm or more. On the other hand, when the coating film of glass is thick, any problem is not caused. However, it cannot be said that coating in an excessively thick manner is a realistic step. When the upper limit of the glass coating thickness is 600

μm, there is no problem in any closed die forging step. The preferable glass coating thickness is 500 μm or less.

<Hot Forging Step>

The above-described forging stock coated with the glass lubricant containing borosilicate glass as a main component is subjected to hot forging.

In the case of the present invention, the hot forging temperature can be defined to be 900 to 1100° C. It is noted that a suitable manufacturing method according to the present invention, among various hot forging methods, is so called "closed die forging" in which a forging stock is pressed with an upper die and a lower die into a required shape. It is noted that when closed die forging is performed, a die to be used is preferably previously heated to a temperature of 400° C. or higher. This is for preventing the viscosity of glass from increasing during forging as the temperature of the glass which is in contact with a die decreases. The die temperature is preferably 500° C. or higher. Since the forming load can be suppressed to be lower, and the viscosity of glass can be maintained lower, the temperature of a heated die is advantageously higher. However, for example, when the material properties of a die to be used are the steel for a hot die defined by JIS, tempering temperature may be defined as the upper limit. For example, in the case of a die made of an Ni-base superalloy, forging temperature can be defined as the upper limit.

It is noted that the most suitable alloy for the method of manufacturing the Ni-base superalloy according to the present invention is 718 alloy. The balance among the amounts of Cr and other oxide coating film-generating elements of 718 alloy is most suitable for the preliminary oxidation step of the present invention. The composition of 718 alloy is publicly known. That is, 718 alloy contains, in terms of mass %, 0.08% or less of C, 0.35% or less of Si, 0.35% or less of Mn, 0.015% or less of P, 0.015% or less of S, 50.0 to 58.0% of Ni, 17.0 to 21.0% of Cr, 2.8 to 3.3% of Mo, 1.0% or less of Co, 0.30% or less of Cu, 0.20 to 0.80% of Al, 0.65 to 1.15% of Ti, 4.75 to 5.50% of Nb+Ta, 0.006% or less of B, and a remainder of Fe and unavoidable impurities.

EXAMPLES

Firstly, as a preliminary test, studies were conducted on the effect of the surface condition of a forging stock on the wettability of a glass lubricant in 718 alloy (in terms of mass %, 55% Ni-18% Cr-0.5% Al-1% Ti-3% Mo-5% (Nb+Ta)-remainder Fe)) which is an Ni-base superalloy.

As a forging stock, a 718 alloy having a diameter of 75 mm and a thickness of 15 mm was prepared. One surface having a diameter of 75 mm was polished with #320. Then, shot blasting was performed. Thereafter, preliminary oxidation for one hour was performed at 600, 800, 900, and 1000° C.

The cross section was observed using an FE-EPMA to obtain the composition of the oxide formed by the preliminary oxidation. Also, the surface of the forging stock having been subjected to preliminary oxidation was degreased. Thereafter, the surface of the forging stock was sprayed with a glass lubricant which contains, in terms of mass %, 11% of $B_2O_3$, 6.5% of $Al_2O_3$, 6% of $Na_2O$, 0.5% of CaO, 0.05% of $K_2O$, and $SiO_2$ as a remainder. Thereafter, the sprayed surface was sufficiently dried to remove a solvent. The thickness of any applied glass lubricant was 250 to 350 μm. The forging stock coated with the glass lubricant was heated at 1000° C. for one hour (referred to as material/glass heating). The forging stock having been subjected to the material/glass heating was evaluated for wettability by using, as an index, the coverage of the glass lubricant to the forging material and the presence or absence of wettability failure in which glass partially flies.

Table 1 illustrates the presence or absence of a Cr oxide by preliminary oxidation and the coverage of glass by material/glass heating. It is noted that an X-ray analyzer was used for confirming that the generated oxide coating film is a Cr oxide film. The average thickness of a Cr oxide coating film was calculated by dividing the area of the Cr oxide coating film by the width of the observation visual field from a Cr element map image obtained by the cross-sectional observation of a material surface with an FE-EPMA. It is noted that the measurement of the thickness of an oxide coating film was performed by randomly observing 10 visual fields.

TABLE 1

| Preliminary oxidation treatment | | | | |
|---|---|---|---|---|
| Heating temperature | Presence or absence of Cr oxide | Glass coverage | Presence or absence of wettability failure of glass | Remarks |
| 600° C. | None | 77.0% | Presence | Comparative example |
| 800° C. | Fragmentarily partly formed | 90.7% | Presence | Comparative example |
| 900° C. | Entirely formed (Average thickness: 0.7 μm) | 95.0% | Absence | Present invention |
| 1000° C. | Entirely formed (Average thickness: 1.2 μm) | 95.8% | Absence | Present invention |

It is understood that as the Cr oxide coating film formed on the entire substrate surface by the above-described preliminary oxidation is thicker, the coverage of glass to the forging stock by material/glass heating becomes higher. This is attributable to the fact that the Cr oxide coating film and the glass form a reaction layer, thereby causing glass to spread by wetting on the substrate surface. FIGS. 1(*a*) and 1(*b*) are appearance photographs of examples of the forging stocks having been subjected to preliminary oxidation at 600° C. and 1000° C. respectively, thereafter coated with glass on the substrate surface, and subjected to material/glass heating at 1000° C.

In FIG. 1(*a*) which was subjected to preliminary oxidation at 600° C., glass partly flies, causing wettability failure. In contrast to this, in FIG. 1(*b*) which was subjected to preliminary oxidation at 1000° C., it is understood that glass favorably spreads by wetting. It is noted that in the present invention, the glass coverage is approximately 95%. This is an influence by the edge of the forging stock. In actual hot forging, it is decided that a glass lubricant having the glass coverage according to the present invention almost completely spreads by wetting.

Figure 2:
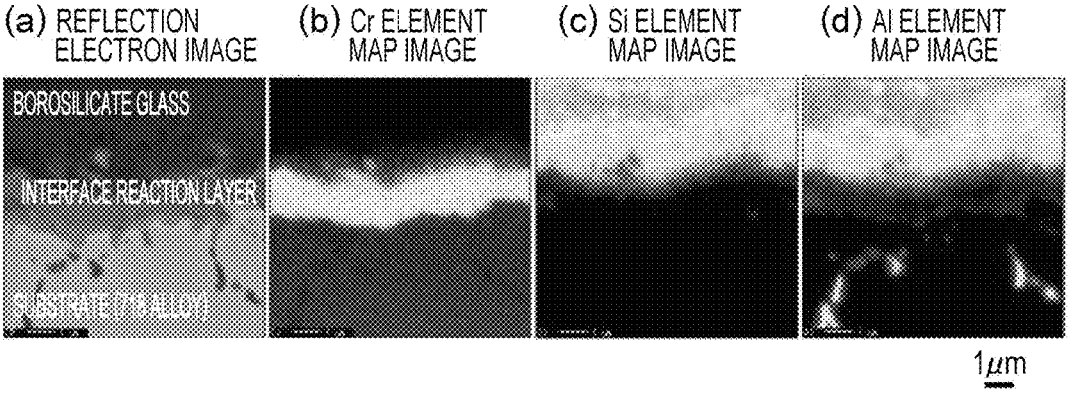
FIG. 2 illustrates an interface structure between a substrate and a glass lubricant (a backscattered electron image and element map images).

An FE-EPMA backscattered electron image observed from the cross-sectional direction of FIG. 1(*b*), and element maps of Cr, Si, and Al are illustrated in FIGS. 2(*a*), 2(*b*), 2(*c*), and 2(*d*), respectively. Portions which look white in the element map images indicate that elements are concentrated. In part of the region where Cr is concentrated, Si and Al of the glass component are concentrated. This demonstrates that the Cr oxide coating film forms a reaction layer at the interface with glass, thereby to enhance adhesive properties. It is noted that the forging stock which was confirmed to have wettability failure in which glass partly flies by material/glass heating was the forging stock having been subjected to preliminary oxidation at 600 and 800° C.

Based on the above-described result of the preliminary test, a tens of thousands ton-class, large-sized forging apparatus was actually used for performing hot forging. In this hot forging, a turbine disk member was manufactured by pressing with an upper die and a lower die. Similarly to the preliminary test, 718 alloy was used as an Ni-base superalloy. As a forging stock, there was used a billet having a diameter of 300 mm and a height of 1000 mm. The forging stock was subjected to preliminary oxidation at 950 to 1000° C. for four hours to prepare a forging stock in which 5 μm of a Cr oxide coating film is generated on its surface. Furthermore, by preliminary oxidation at 600 to 700° C. for four hours, there was prepared a forging stock in which a Cr oxide coating film is hardly generated with less than 0.5 μm. Thereafter, the surface of the forging stock was sprayed with a borosilicate glass lubricant which contains 11% of $B_2O_3$, 6.5% of $Al_2O_3$, 6% of $Na_2O$, 0.5% of CaO, 0.05% of $K_2O$, and $SiO_2$ as a remainder. Thereafter, a solvent was removed by sufficient drying. The thickness of the applied glass lubricant was approximately 300 μm.

This forging stock coated with the glass lubricant containing borosilicate glass as a main component was subjected to closed die forging in a stepwise manner while repeating reheating, thereby to prepare a roughly-forged intermediate. Thereafter, final closed die forging in a near net shape with a diameter of 1 m or more was performed.

At that time, the temperature of a die made of JIS-SKD61 was heated to 500° C. The temperature of the forging stock coated with the glass lubricant containing borosilicate glass as a main component was increased to 950 to 1000° C. which is forging temperature. The forging stock heated to forging temperature was placed on a lower die. Then, an upper die was lowered to perform hot forging (hot press) in which pressing is performed with an upper die and a lower die. It is noted that in the forging stock having been subjected to preliminary oxidation at 950 to 1000° C., the applied glass lubricant of the forging stock placed on the lower die remained uniform.

Hot forging could be performed while a press load did not excessively increase during hot forging. The forging stock having been subjected to hot forging did not have any observed defect, and had a favorable shape. Regarding its microstructure, there was obtained a fine recrystallization structure of No. 8 or higher in terms of the ASTM crystal grain size number. On the other hand, in the forging stock having been subjected to preliminary oxidation at 600 to 700° C., wettability failure of a glass lubricant was caused on its entire surface. During hot forging, the preliminary oxidized material at 600 to 700° C. exhibited a forging load, during hot forging, which is higher than that of the preliminary oxidized material at 950 to 1000° C. Furthermore, eccentricity was caused in its shape. In this manner, a favorable forged material was not obtained. The preliminary oxidized material at 950 to 1000° C. exhibited a forging load which was approximately 5% lower than that of the preliminary oxidized material at 600 to 700° C. Also, its roundness could be improved by 27%. When the manufacturing method according to the present invention was applied, there was obtained a forging stock having a substantially round shape.

As understood from the above result, according to the present invention, a uniform coat of a glass lubricant can be maintained even after heated to hot forging temperature. Therefore, for example, even in the case of a large-sized and complicated product, hot forging can be performed at a low load with a near-net-shape forged product.

The invention claimed is:

1. A method of manufacturing an Ni-base superalloy, in which a forging stock including an Ni-base superalloy, coated with a lubricant, is subjected to hot forging, comprising:

a preliminary oxidation step of previously generating a Cr oxide coating film having a film thickness of 0.5 to 50 μm on the forging stock;

a lubricant coating step of coating a Cr oxide coating film formed on the forging stock having been subjected to the preliminary oxidation step with a glass lubricant including borosilicate glass as a main component; and a hot forging step of hot forging the forging stock having been subjected to the lubricant coating step.

2. The method of manufacturing an Ni-base superalloy according to claim 1, wherein a thickness of the glass lubricant applied in the lubricant coating step is 100 to 600 μm.

3. The method of manufacturing an Ni-base superalloy according to claim 1, wherein a heating temperature in the preliminary oxidation step is 900° C. to a hot forging temperature.

4. The method of manufacturing an Ni-base superalloy according to claim 1, wherein the Ni-base superalloy contains, in terms of mass %, 0.08% or less of C, 0.35% or less of Si, 0.35% or less of Mn, 0.015% or less of P, 0.015% or less of S, 50.0 to 55.0% of Ni, 17.0 to 21.0% of Cr, 2.8 to 3.3% of Mo, 1.0% or less of Co, 0.30% or less of Cu, 0.20 to 0.80% of Al, 0.65 to 1.15% of Ti, 4.75 to 5.50% of Nb+Ta, 0.006% or less of B, and a remainder of Fe and unavoidable impurities.

5. The method of manufacturing an Ni-base superalloy according to claim 1, wherein the hot forging step is closed die forging using a die heated to a temperature of 400° C. or higher.

6. The method of manufacturing an Ni-base superalloy according to claim 5, wherein a heating temperature in the preliminary oxidation step is 900° C. to a hot forging temperature.

7. The method of manufacturing an Ni-base superalloy according to claim 5, wherein a thickness of the glass lubricant applied in the lubricant coating step is 100 to 600 μm.

8. The method of manufacturing an Ni-base superalloy according to claim 5, wherein in the hot forging step the forging stock heated to a temperature of 900 to 1100° C. is subjected to hot forging.

9. The method of manufacturing an Ni-base superalloy according to claim 8, wherein a heating temperature in the preliminary oxidation step is 900° C. to a hot forging temperature.

10. The method of manufacturing an Ni-base superalloy according to claim 8, wherein the Ni-base superalloy contains, in terms of mass %, 0.08% or less of C, 0.35% or less of Si, 0.35% or less of Mn, 0.015% or less of P, 0.015% or less of S, 50.0 to 55.0% of Ni, 17.0 to 21.0% of Cr, 2.8 to 3.3% of Mo, 1.0% or less of Co, 0.30% or less of Cu, 0.20 to 0.80% of Al, 0.65 to 1.15% of Ti, 4.75 to 5.50% of Nb+Ta, 0.006% or less of B, and a remainder of Fe and unavoidable impurities.

11. The method of manufacturing an Ni-base superalloy according to claim 5, wherein the Ni-base superalloy contains, in terms of mass %, 0.08% or less of C, 0.35% or less of Si, 0.35% or less of Mn, 0.015% or less of P, 0.015% or less of S, 50.0 to 55.0% of Ni, 17.0 to 21.0% of Cr, 2.8 to 3.3% of Mo, 1.0% or less of Co, 0.30% or less of Cu, 0.20 to 0.80% of Al, 0.65 to 1.15% of Ti, 4.75 to 5.50% of Nb+Ta, 0.006% or less of B, and a remainder of Fe and unavoidable impurities.

12. The method of manufacturing an Ni-base superalloy according to claim 1, wherein in the hot forging step the forging stock heated to a temperature of 900 to 1100° C. is subjected to hot forging.

13. The method of manufacturing an Ni-base superalloy according to claim 12, wherein a thickness of the glass lubricant applied in the lubricant coating step is 100 to 600 μm.

14. The method of manufacturing an Ni-base superalloy according to claim 12, wherein a heating temperature in the preliminary oxidation step is 900° C. to a hot forging temperature.

15. The method of manufacturing an Ni-base superalloy according to claim 12, wherein the Ni-base superalloy contains, in terms of mass %, 0.08% or less of C, 0.35% or less of Si, 0.35% or less of Mn, 0.015% or less of P, 0.015% or less of S, 50.0 to 55.0% of Ni, 17.0 to 21.0% of Cr, 2.8 to 3.3% of Mo, 1.0% or less of Co, 0.30% or less of Cu, 0.20 to 0.80% of Al, 0.65 to 1.15% of Ti, 4.75 to 5.50% of Nb+Ta, 0.006% or less of B, and a remainder of Fe and unavoidable impurities.

* * * * *